US009184489B2

(12) United States Patent
Lin

(10) Patent No.: US 9,184,489 B2
(45) **Date of Patent: *Nov. 10, 2015**

(54) ANTENNA FIXING STRUCTURE

(71) Applicant: GRAND-TEK TECHNOLOGY CO., LTD., New Taipei (TW)

(72) Inventor: Yu-Wei Lin, New Taipei (TW)

(73) Assignee: GRAND-TEK TECHNOLOGY CO., LTD., New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 14/299,841

(22) Filed: Jun. 9, 2014

(65) Prior Publication Data

US 2015/0280307 A1 Oct. 1, 2015

(30) Foreign Application Priority Data

Mar. 26, 2014 (TW) ..... 103205184 U

(51) Int. Cl.
*A47B 96/06* (2006.01)
*H01Q 1/12* (2006.01)

(52) U.S. Cl.
CPC ..... *H01Q 1/1264* (2013.01); *H01Q 1/12* (2013.01)

(58) Field of Classification Search
CPC ..... H01Q 1/1264; H01Q 1/12
USPC ..... 248/219.1, 229.1, 229.14, 291.1, 299.1, 248/230.5, 231.61; 343/890, 892, 898
See application file for complete search history.

(56) References Cited

U.S. PATENT DOCUMENTS

| | | | | | |
|---|---|---|---|---|---|
| 3,162,407 | A * | 12/1964 | Yax | 248/514 |
| 4,513,923 | A * | 4/1985 | Ulics | 242/598.5 |
| 5,926,151 | A * | 7/1999 | Hagiwara et al. | 343/882 |
| 6,031,508 | A * | 2/2000 | Ishizuka et al. | 343/882 |
| 6,407,713 | B1 * | 6/2002 | Mallenius | 343/765 |
| 7,142,168 | B1 * | 11/2006 | Sinclair | 343/882 |
| 7,883,065 | B2 * | 2/2011 | Nelson | 248/201 |
| 2002/0105477 | A1 * | 8/2002 | Bragg et al. | 343/892 |
| 2012/0026065 | A1 * | 2/2012 | Lo | 343/890 |

* cited by examiner

*Primary Examiner* — Gwendolyn W Baxter
(74) *Attorney, Agent, or Firm* — Chun-Ming Shih; HDLS IPR SERVICES

(57) ABSTRACT

An antenna fixing structure includes an antenna box and a fixing frame. The antenna box includes a casing with a first circumference defined by a first center and a first radius, and the casing has equidistant first connecting portions disposed along the first circumference. The fixing frame includes a carrying board with a second circumference defined by a second center and a second radius, and the carrying board has equidistant second connecting portions disposed along the second circumference, so that the first connecting portions and the second connecting portions can be rotably installed with respect to the first and second centers and coupled to each other. Therefore, the antenna box can be rotated to a predetermined position and then fixed to the fixing frame, and the antenna fixing structure has the effect of adjusting the direction, position or angle of an antenna.

9 Claims, 7 Drawing Sheets

ANTENNA FIXING STRUCTURE

FIELD OF THE INVENTION

The present invention generally relates to the assembly of an antenna and a fixing frame, and more particularly to an antenna fixing structure.

BACKGROUND OF THE INVENTION

As technologies advance, people rely on mobile devices, wireless transmission devices and wireless network increasingly more, so that antennas used for transmitting or receiving radio waves become popular and used extensively in our living environments.

For antennas or dish antennas, the direction and angle of the antennas are usually adjusted according to a signal transmitting or receiving direction in order to improve the efficiency of receiving or transmitting signals. Therefore, it is a main issue for related manufacturers to adjust the direction or angle of an antenna effectively.

In view of the aforementioned problem of the prior art, the inventor of the present invention based on years of experience in the related industry to conduct extensive researches and experiments, and finally designed a feasible solution to overcome the problem of the prior art.

SUMMARY OF THE INVENTION

Therefore, it is a primary objective of the present invention to provide an antenna fixing structure having a first connecting portion and a second connecting portion rotably installed with respect to a first center and a second center and coupled with each other, so that an antenna box can be rotated to a predetermined position and then fixed to a fixing frame, and the antenna fixing structure achieves the effect of adjusting the direction or angle of the antenna.

To achieve the aforementioned objectives, the present invention provides an antenna fixing structure, comprising:

an antenna box, having a casing, and the casing having a first circumference defined by a first center and a first radius, and the casing further having a plurality of equidistant first connecting portions disposed along the first circumference; and a fixing frame, having a carrying board, and the carrying board having a second circumference defined by a second center and a second radius, and the carrying board further having a plurality of equidistant second connecting portions disposed along the second circumference, such that the first connecting portions and the second connecting portions can be rotably installed with respect to the first center and the second center and coupled to each other.

The present invention has the following effects:

1. The antenna box can be rotated to left and right with respect to the first center and then fixed to the carrying board. In addition, the antenna fixing structure can adjust the angle of elevation of the antenna box through the pivotal connection of the first pivot block and the second pivot block, so that the antenna fixing structure has the capability of adjusting the left and right directions and positions and the angle of elevation of the antenna box, and the antenna fixing structure achieves the effect of adjusting the antenna box with two-dimensional directions.

2. The quantity of second connecting portions is equal to n times of the quantity of first connecting portions, wherein n is a natural number greater than or equal to 1. The greater the value of n, the greater the quantity of first connecting portions corresponding to the second connecting portions. Therefore, the antenna box can be rotated in broader and precise directions and positions with respect to the carrying board to improve the capability of adjusting the left and right directions and positions of the antenna fixing structure.

3. A rib between the first pivot block and the second pivot block is provided to increase the friction between the first pivot block and the second pivot block and further pivotally coupling and combining the first pivot block and the second pivot block more securely.

4. The first limit block is extended from the first pivot block, and the second limit block is extended from the second pivot block, and the second limit block can be stopped and fixed to a position by the first limit block, so as to limit the angle of elevation of the antenna box and prevent the antenna box from hitting the rod.

DESCRIPTION OF THE PREFERRED EMBODIMENTS

The technical contents of the present invention will become apparent with the detailed description of preferred embodiments accompanied with the illustration of related drawings as follows. It is noteworthy that the embodiments are provided for the purpose of illustrating the invention instead of limiting the scope of the invention.

With reference to FIGS. 1 to 8 for an antenna fixing structure of the present invention, the antenna fixing structure 10 comprises an antenna box 1 and a fixing frame 2.

Figure 1:
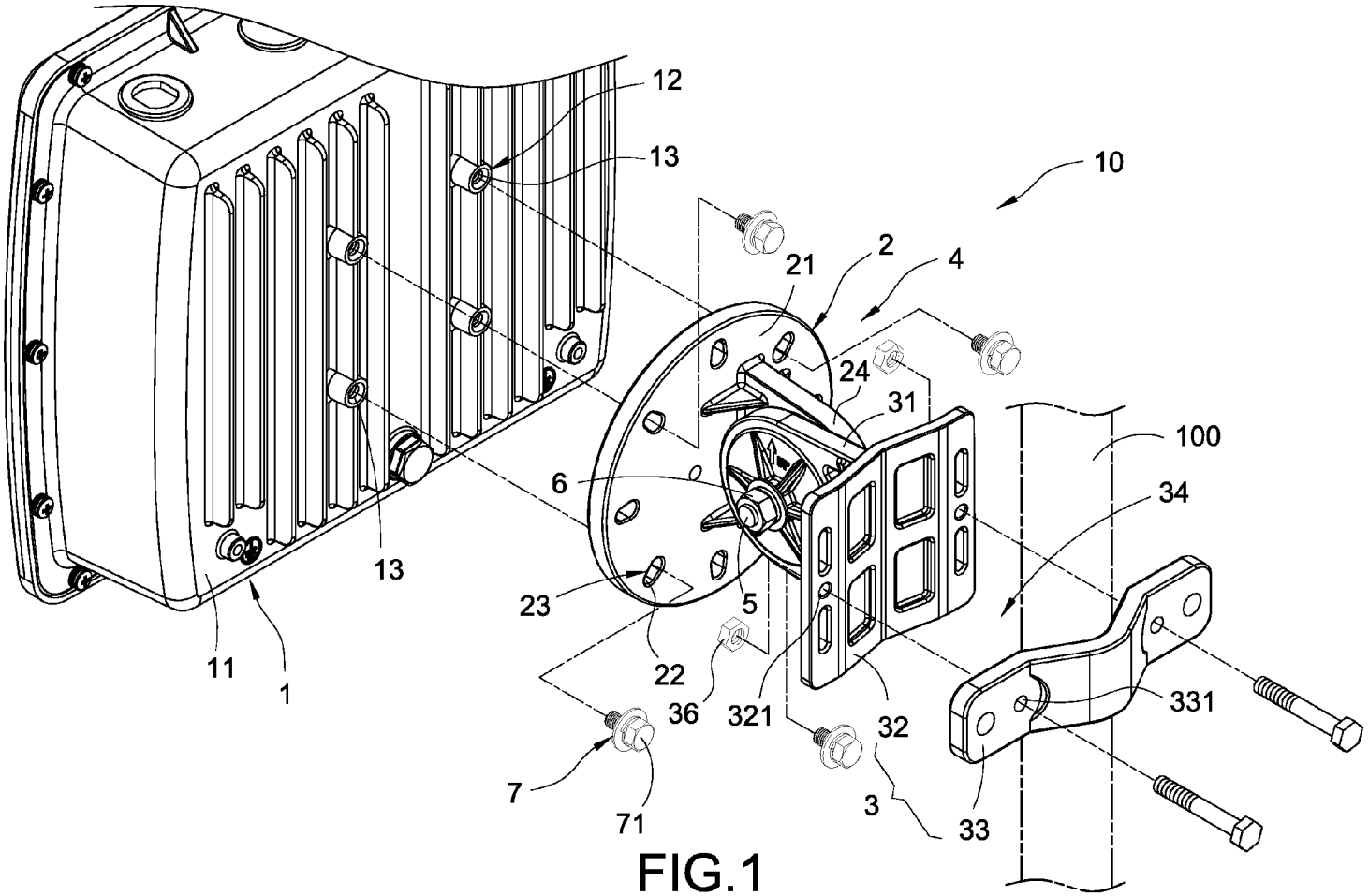
FIG. 1 is an exploded view of an antenna fixing structure of the present invention.
Figure 3:
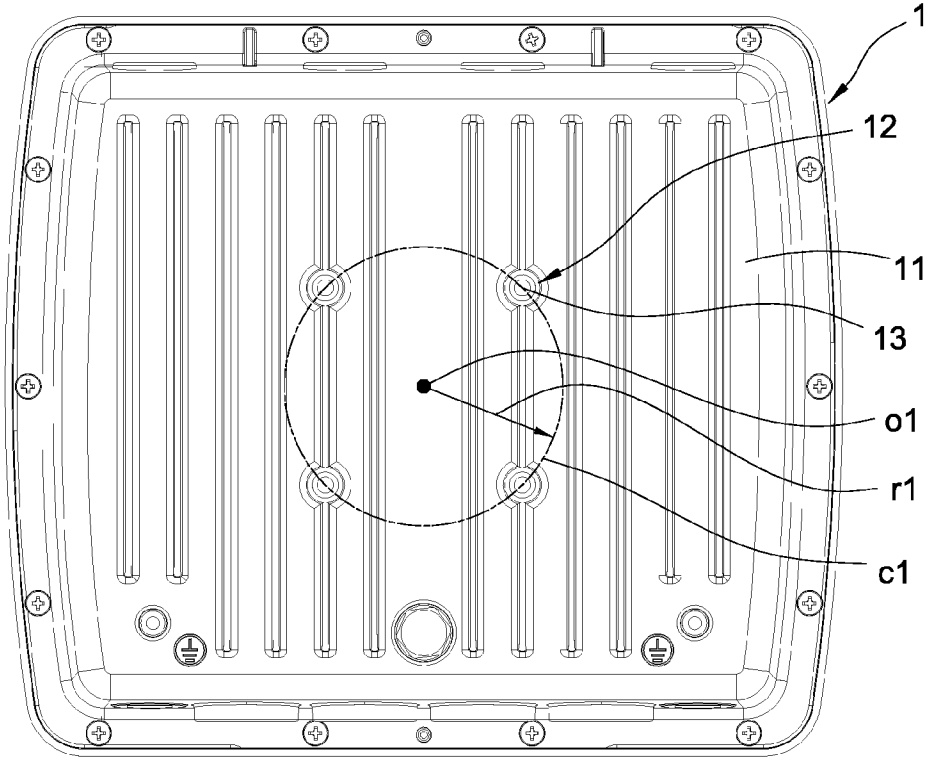
FIG. 3 is a schematic view of a plurality of equidistant first connecting portions disposed along a first circumference of a casing of the present invention.

In FIGS. 1 and 3, the antenna box 1 includes a casing 11, and the casing 11 has a first circumference c1 defined by a first center ol and a first radius r1, and the casing 11 further has a plurality of equidistant first connecting portions 12 disposed along the first circumference c1, wherein each first connecting portion 12 is formed by a fixing hole 13 of the casing 11.

Figure 2:
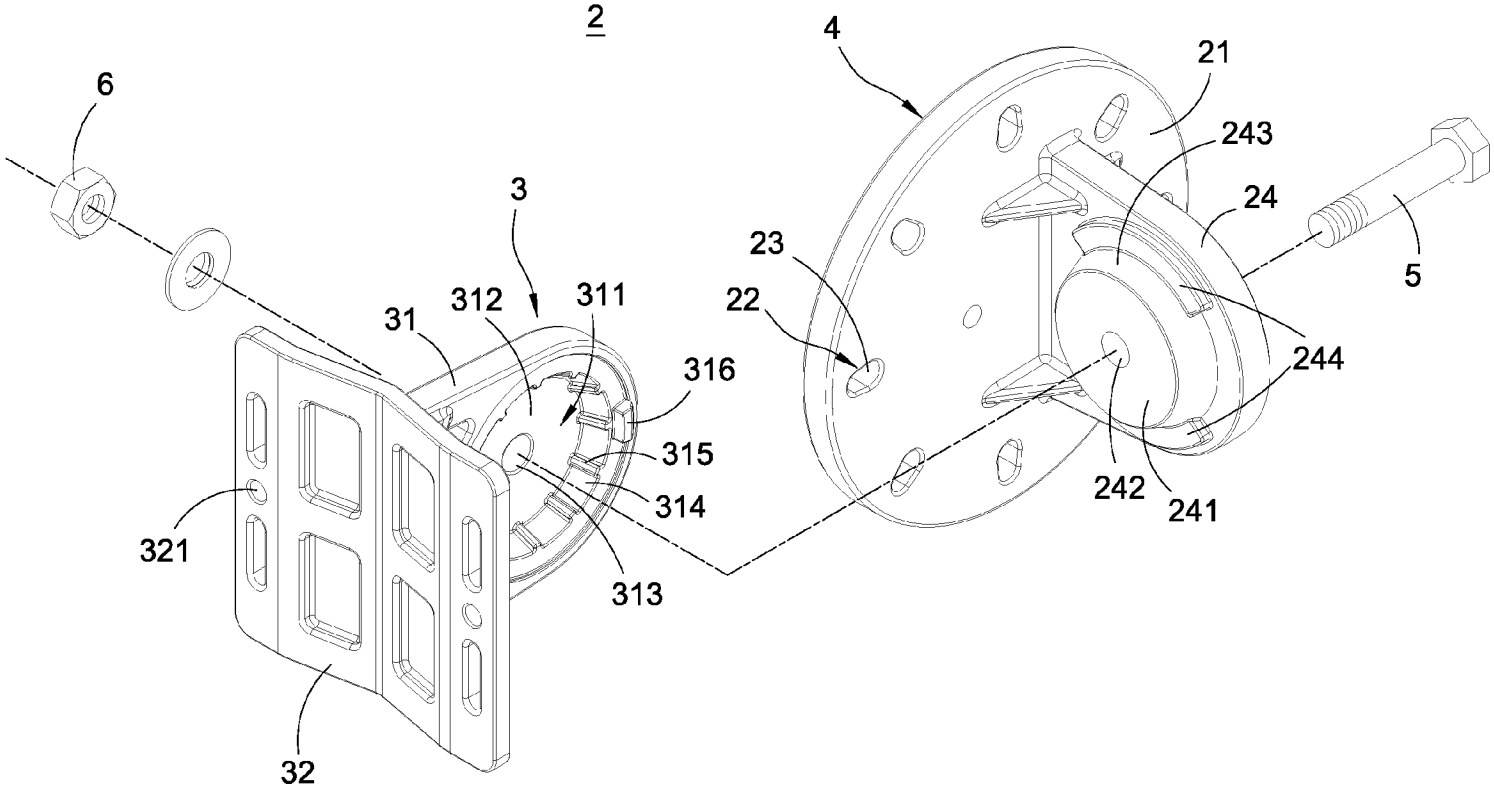
FIG. 2 is another exploded view of an antenna fixing structure of the present invention.
Figure 4:
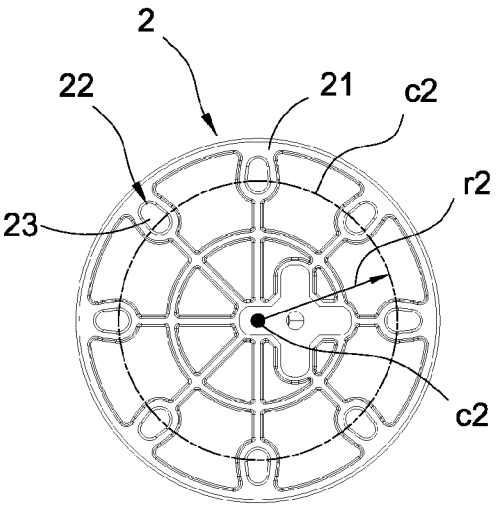
FIG. 4 is a schematic view of a plurality of equidistant second connecting portions disposed along a second circumference of a casing of the present invention.

In FIGS. 1, 2 and 4, the fixing frame 2 includes a carrying board 21, and the carrying board 21 has a second circumference c2 defined by a second center o2 and a second radius r2, and the carrying board 21 further has a plurality of equidistant second connecting portions 22 disposed along the second circumference c2, so that the first connecting portions 12 and the second connecting portions 22 can be rotably installed with respect to the first center ol and the second center o2 and coupled to each other, wherein each second connecting portion 22 is formed by a through hole 23 of the carrying board 21.

Specifically, the quantity of second connecting portions 22 is equal to n times of the quantity of first connecting portions 12, and n is a natural number greater than or equal to 1. In addition, the second radius r2 may be equal to, greater than or smaller than the first radius r1, and the second radius r2 is substantially equal to the first radius r1 in this preferred embodiment. In other words, the second radius r2 is approximately equal to the first radius r1.

Figure 5:
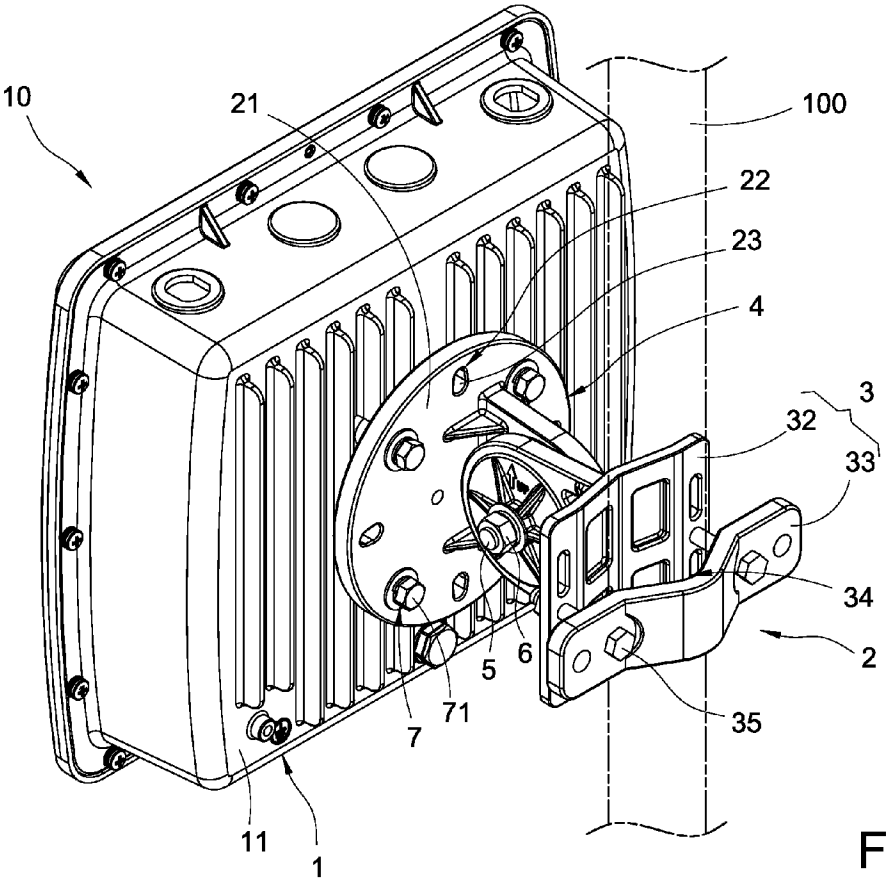
FIG. 5 is a perspective view of an antenna fixing structure of the present invention.

In FIGS. 1, 2 and 5, the fixing frame 2 includes a fixed connecting base 3 and a moving base 4, and the fixed connecting base 3 has a first pivot block 31, and the moving base 4 is formed by a carrying board 21 and a second pivot block 24 extended from the carrying board 21, and the first pivot block 31 and the second pivot block 24 are pivotally coupled to each other, so that the moving base 4 is pivotally coupled to the fixed connecting base 3.

Specifically, the fixed connecting base 3 includes a first clamping board 32 and a second clamping board 33 coupled to each other, and a clamping space 34 is defined between the first clamping board 32 and the second clamping board 33, and the first pivot block 31 is formed and extended from the first clamping board 32.

The fixed connecting base 3 further includes a plurality of screw rods 35 and a plurality of nuts 36, and the first clamping board 32 has a plurality of first penetrating holes 321, and the second clamping board 33 has a plurality of second penetrating holes 331, and each screw rod 35 is passed through each respective first penetrating hole 321 and each respective second penetrating hole 331 and screwed and fixed to each respective nut 36. When the rod 100 is accommodated in the clamping space 34, the first clamping board 32 and the second clamping board 33 jointly clamp the rod 100 through the screw rod 35 and fixed onto the rod 100, so that the antenna fixing structure 10 can be securely installed to the rod 100.

The fixing frame 2 further includes a screw rod 5 and a nut 6, and the first pivot block 31 has a groove 311 and a first through opening 313 formed at a bottom side 312 of groove 311, and a protrusion 241 is extended from the second pivot block 24 and a second through opening 242 is formed on the protrusion 241. The protrusion 241 is accommodated in the groove 311 and rotatable with respect to the groove 311, and the screw rod 5 is passed through the respective first through opening 313 and second through opening 242 and screwed and fixed to the respective nut 6.

The groove 311 has a first conical surrounding wall 314 disposed around an inner periphery of the groove 311 and a plurality of ribs 315 extended from the first conical surrounding wall 314. The protrusion 241 has a second conical surrounding wall 243 disposed around an outer periphery of the protrusion 241, and the second conical surrounding wall 243 and the ribs 315 abut against each other.

In addition, a first limit block 316 is extended from the first pivot block 31, and a second limit block 244 is extended from the second pivot block 24, and the second limit block 244 can be stopped and fixed to a position by the first limit block 316.

The antenna fixing structure 10 further comprises a plurality of fixing elements 7, and each fixing element 7 is passed through each respective through hole 23 and each respective fixing hole 13. In a preferred embodiment of the present invention, each fixing element 7 is a screw 71, and each fixing hole 13 has a thread formed at an inner periphery of the fixing hole 13, and each screw 71 is screwed and fixed to each respective thread.

In FIGS. 1 and 5, the antenna fixing structure 10 of the present invention comprises an antenna box 1 having a casing 11 with a first circumference cl defined by a first center of and a first radius r1, wherein the casing 11 has a plurality of equidistant first connecting portions 12 disposed along the first circumference c1; a fixing frame 2 having a carrying board 21 with a second circumference c2 defined by a second center o2 and a second radius r2, wherein the carrying board 21 has a plurality of equidistant second connecting portions 22 disposed along the second circumference c2, so that the first connecting portions 12 and the second connecting portions 22 can be rotably installed with respect to the first center o1 and the second center o2 and coupled to each other. Therefore, the antenna box 1 can be rotated to a predetermined position and then fixed to the fixing frame 2, and the antenna fixing structure 10 has the effect of adjusting the direction, position or angle of the antenna.

In addition, the first pivot block 31 has a groove 311, and a protrusion 241 is extended from the second pivot block 24, and a first through opening 313 is formed at a bottom side 312 of the groove 311, and a second through opening 242 is formed on the protrusion 241, so that the protrusion 241 can be accommodated in the groove 311 and rotated with respect to the groove 311, and the screw rod 5 is passed through the respective first through opening 313 and second through opening 242 and screwed and fixed to the respective nut 6, and the first pivot block 31 and the second pivot block 24 are pivotally coupled to each other.

Now, the inner periphery of the groove 311 has the first conical surrounding wall 314 and the rib 315 extended from the first conical surrounding wall 314, and the outer periphery of the protrusion 241 has the second conical surrounding wall 243, and the second conical surrounding wall 243 and the rib 315 abut against each other to increase the friction between the second conical surrounding wall 243 and the rib 315. When the screw rod 5 is secured to the nut 6 tightly, the first conical surrounding wall 314 and the second conical surrounding wall 243 are attached with each other closely, so that the first pivot block 31 and the second pivot block 24 are pivotally coupled and secured with each other more securely.

In addition, the first limit block 316 is extended from the extended form the first pivot block 31, and the second limit block 244 is extended from the second pivot block 24, and the second limit block 244 can be stopped and fixed to a position by the first limit block 316, so as to limit the angle of elevation of the antenna box 1 and prevent the antenna box 1 from hitting the rod 100.

Figure 6:
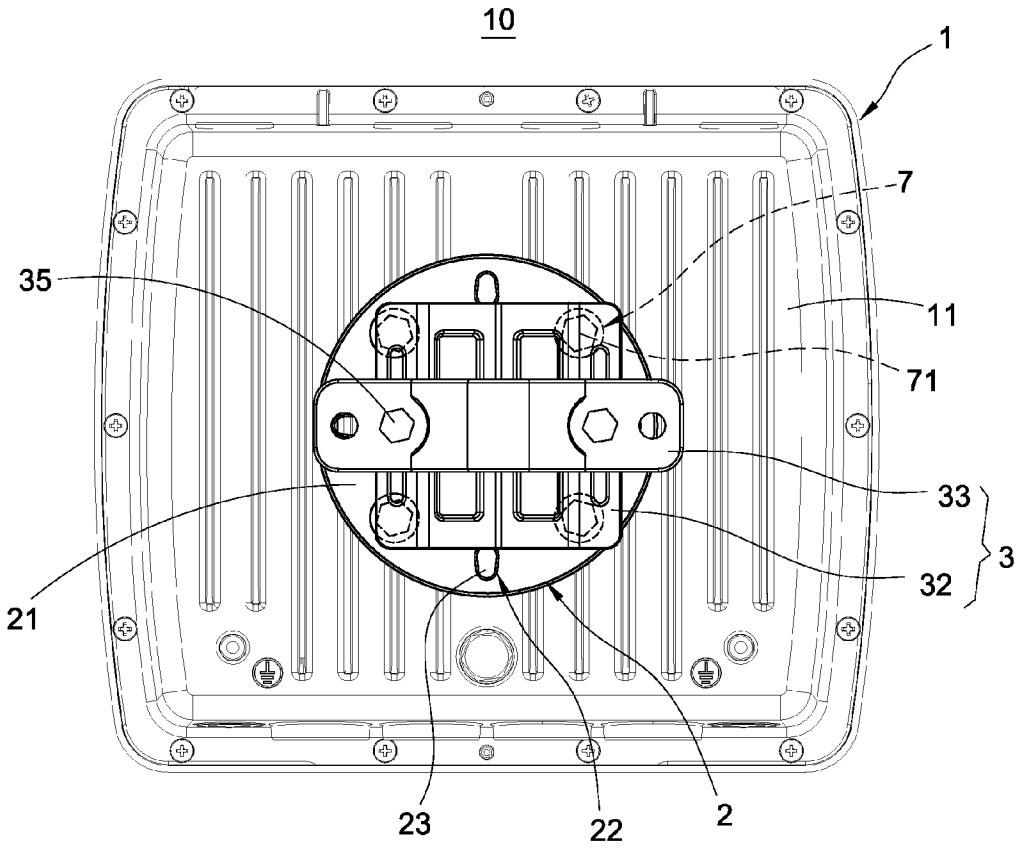
FIG. 6 is a schematic view of a using status of an antenna fixing structure of the present invention.
Figure 7:
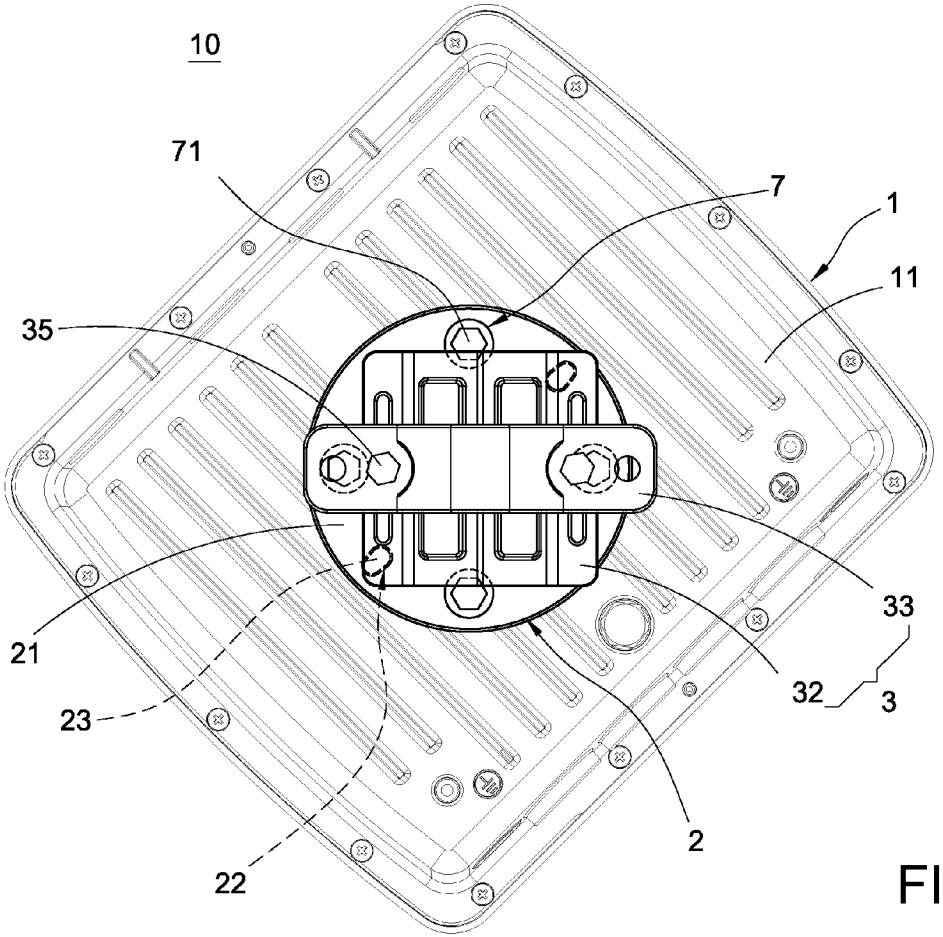
FIG. 7 is a schematic view of another using status of an antenna fixing structure of the present invention.
Figure 8:
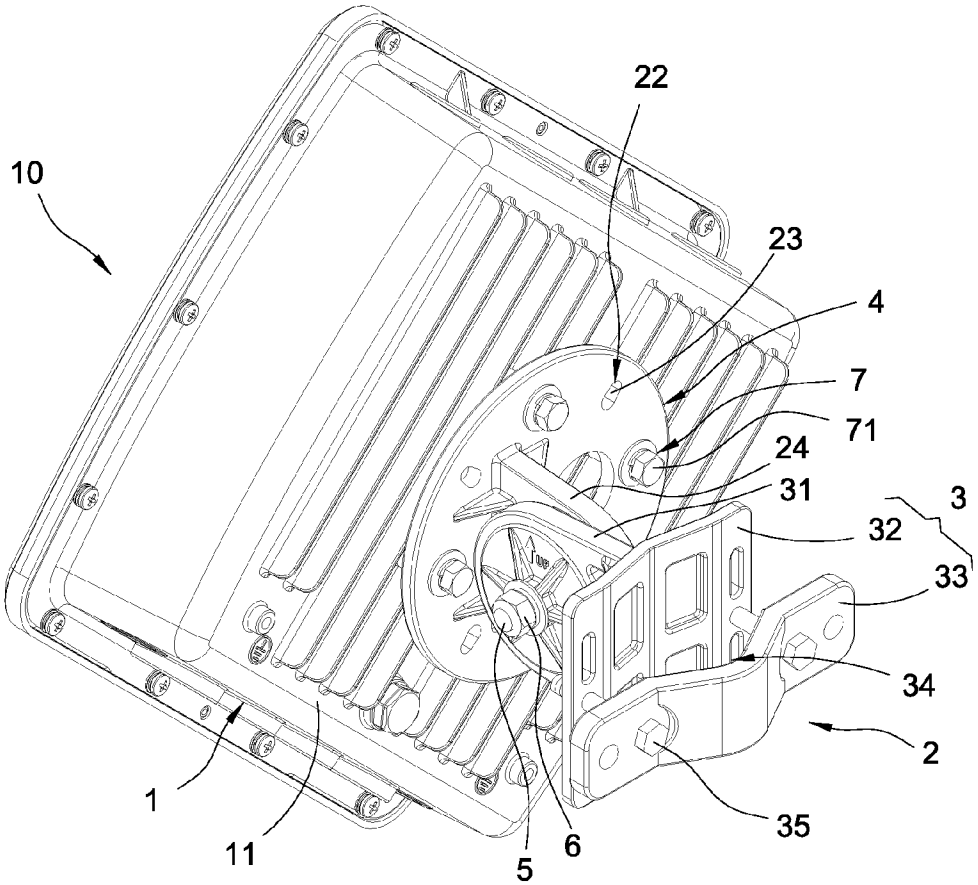
FIG. 8 is a schematic view of a further using status of an antenna fixing structure of the present invention.

With reference to FIGS. 6 to 8 for different using statuses of the antenna fixing structure 10 of the present invention together with FIGS. 3 and 4, he first connecting portions 12 and the second connecting portions 22 are rotably installed with respect to the first center of and the second center o2 and coupled to each other.

In FIGS. 6 and 7, the antenna box 1 is rotated to the left or right by using the first center of as the center, and then the first connecting portion 12 and the second connecting portion 22 are coupled to each other and fixed to the carrying board 21. In FIG. 8, the antenna fixing structure 10 can adjust the angle of elevation of the antenna box 1 through the pivotal connection of the first pivot block 31 and the second pivot block 24, so that the antenna fixing structure 10 achieves the capability of adjusting the left and right directions and the angle of elevation of the antenna box 1, and the antenna fixing structure 10 has the effect of adjusting the antenna box 1 with two-dimensional directions.

Further, the quantity of second connecting portions 22 is equal to n times of the quantity of first connecting portions 12, wherein n is a natural number greater than or equal to 1. For a greater value of n, more first connecting portions 12 corresponsive to the second connecting portion 22 can be selected. In this preferred embodiment, n is equal to 2, and the quantity of first connecting portions 12 is equal to 4, and the quantity of second connecting portions 22 is equal to 8. The antenna box 1 of this preferred embodiment can be rotated to an angle of 0°, 45°, 90°, 135°, 180°, 225°, 270° or 315° with respect to the carrying board 21, so that the antenna box 1 can be rotated to the left and right direction with a broader and precise angle with respect to the carrying board 21 to enhance the capability of adjusting the left and right directions and positions of the antenna fixing structure 10.

While the invention has been described by means of specific embodiments, numerous modifications and variations could be made thereto by those skilled in the art without departing from the scope and spirit of the invention set forth in the claims.

What is claimed is:

1. An antenna fixing structure, comprising:

an antenna box, including a casing having a plurality of equidistant first connecting portions disposed along a circular path defined by a first center and a first radius; and a fixing frame, including a carrying board with a circumference defined by a second center and a second radius, and the carrying board having a plurality of equidistant second connecting portions disposed along the circumference, so that the first connecting portions and the second connecting portions can be rotably installed with respect to the first center and the second center and coupled to each other, wherein the fixing frame includes a fixed connecting base and a moving base, and the fixed connecting base has a first pivot block, and the moving base is formed by the carrying board and a second pivot block extended from the carrying board, and the first pivot block and the second pivot block are pivotally coupled to each other;

wherein the fixing frame further comprises a screw rod and a nut, and the first pivot block has a groove and a first through opening formed at the bottom side of the groove, and the second pivot block has a protrusion extended therefrom, and the protrusion has a second through opening formed thereon, and the protrusion is accommodated in the groove and rotatable with respect to the groove, and the screw rod is passed through the respective first through opening and the respective second through opening and screwed and fixed to the respective nut.

2. The antenna fixing structure of claim 1, wherein the quantity of second connecting portions is equal to n times of the quantity of first connecting portions, and n is a natural number greater than or equal to 1.

3. The antenna fixing structure of claim 1, wherein the second radius is substantially equal to the first radius.

4. The antenna fixing structure of claim 3, further comprising a plurality of fixing elements, each being formed by a fixing hole of the casing, and each of the second connecting portions being formed by a through hole of the carrying board, and the fixing elements being passed and coupled to the respective through holes and fixing holes.

5. The antenna fixing structure of claim 3, wherein each of the fixing elements is a screw, and each of the fixing holes has a thread formed on an inner periphery of the fixing hole, and each screw is screwed and fixed to each respective thread.

6. The antenna fixing structure of claim 1, wherein the fixed connecting base includes a first clamping board and a second clamping board coupled to each other, and a clamping space is defined between the first clamping board and the second clamping board, and the first pivot block is formed and extended from the first clamping board.

7. The antenna fixing structure of claim 6, wherein the fixed connecting base further comprises a plurality of screw rods and a plurality of nuts, and the first clamping board has a plurality of first penetrating holes, and the second clamping board has a plurality of second penetrating holes, and each screw rod is passed through each respective first penetrating hole and each respective second penetrating hole and screwed and fixed to each respective nut.

8. The antenna fixing structure of claim 1, wherein the groove has a first conical surrounding wall disposed around an inner periphery of the groove, and a plurality of ribs extended from the first conical surrounding wall, and the protrusion has a second conical surrounding wall disposed around an outer periphery of the protrusion and the second conical surrounding wall and the ribs abut against one another.

9. The antenna fixing structure of claim 1, wherein the first pivot block has a first limit block extended therefrom, and the second pivot block has a second limit block extended therefrom, and the second limit block can be stopped and fixed to a position by the first limit block.

* * * * *